US008043106B1

(12) United States Patent
Morello et al.

(10) Patent No.: US 8,043,106 B1
(45) Date of Patent: Oct. 25, 2011

(54) LOW PROFILE SOCKET CONNECTOR WITH FLEXING LOCK ARM

(75) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/750,146

(22) Filed: Mar. 30, 2010

(51) Int. Cl.
*H01R 13/627* (2006.01)

(52) U.S. Cl. ..... 439/352

(58) Field of Classification Search ..... 439/153, 439/357–358, 351–354, 676, 595
See application file for complete search history.

(56) References Cited

U.S. PATENT DOCUMENTS 4,433,888 A * 2/1984 Winger ..... 439/328
5,378,168 A * 1/1995 Sumida ..... 439/358
5,558,530 A * 9/1996 Morello et al. ..... 439/189
6,419,515 B1 * 7/2002 Okayasu ..... 439/358
6,461,056 B1 * 10/2002 Besler et al. ..... 385/76
6,896,524 B1 * 5/2005 Morello et al. ..... 439/66
7,201,595 B1 * 4/2007 Morello ..... 439/271
7,503,793 B2 * 3/2009 Morello ..... 439/352
2007/0173105 A1 * 7/2007 Morello ..... 439/449
2007/0254518 A1 * 11/2007 Nealle ..... 439/352

* cited by examiner

*Primary Examiner* — Jean F Duverne
(74) *Attorney, Agent, or Firm* — Thomas N. Twomey

(57) ABSTRACT

A socket connector body includes a shroud having an opening, a lock arm, a substantially unyielding, non-resilient beam member, and means to pivot the lock arm. The lock arm includes a forward end portion and middle portion having an inward extending lock nib. The means of the lock arm pivots the forward end portion toward the non-resilient beam member from a free state of rest such that the forward end portion engages the non-resilient beam member. Further pivoting of the lock arm causes the middle portion of the lock arm to flexibly arch outwardly and away from the shroud such that the lock nib is lifted outwardly away from the plug connector body and out of engagement therewith to enable retraction of the plug connector body from the shroud through the opening.

17 Claims, 6 Drawing Sheets

LOW PROFILE SOCKET CONNECTOR WITH FLEXING LOCK ARM

TECHNICAL FIELD

This invention relates generally to electrical connectors, more particularly, provisions of a lock arm in cooperation with a non-resilient beam member allow mated electrical connector bodies to be disconnected.

BACKGROUND OF INVENTION

It is known, according to U.S. Pat. No. 7,503,793 and referring to FIG. 1, to disconnect a plug connector (1) from a socket connector (2) by applying a force to a resilient transverse hold-down beam (3) disposed on the socket connector (2). A lock arm (4) of the socket connector (2) pivots after a depressible handle (8) is depressed to allow a free end (5) of the lock arm (4) to engage the resilient hold-down beam (3) and apply a force that causes the resilient hold-down beam (3) to flex. As the resilient hold-down beam (3) is flexibly raised, or elevated away from the plug connector (1), a lock nib (6) disposed on the lock arm (4) is also elevated that allows the plug connector (1) to be disconnected from a shroud (7) of the socket connector (2).

With smaller sized connector bodies, a length of the hold-down beam is sufficiently reduced such that the resilient hold-down beam becomes non-resilient. Thus, when the lock arm applies the force to a non-resilient hold-down beam, the non-resilient hold-down beam does not flex. The non-resilient hold-down beam remains substantially in the same position as if no force was applied. When the non-resilient hold-down beam is not flexibly displaced, the lock nib is not elevated and the plug connector may not be retracted from the socket connector without possible damage to the plug and socket connector, respectively. It is desirable for the socket connector to receive and also allow retraction of the plug connector without potential concomitant damage occurring to the plug and socket connectors.

What is needed is a socket connector body that receives a corresponding plug connector body while reliably allowing a lock nib on the socket connector body to be elevated so that a plug connector body may be retracted from the socket connector body without damaging the connector bodies, especially when employing smaller sized electrical connector bodies that include a non-resilient beam member.

SUMMARY OF THE INVENTION

A socket connector body is provided and includes a shroud, a lock arm, a substantially unyielding, non-resilient beam member. The lock arm includes a forward end portion and a middle portion in connection with the forward end portion. The middle portion includes an inwardly extending lock nib. The shroud includes an opening that is adapted to receive a plug connector through the opening. The non-resilient beam member is integrally connected with the shroud and adapted for communication with the forward end portion of the lock arm. The means of the lock arm pivots the forward end portion towards the non-resilient beam member from a free state of rest such that the forward end makes contact with the non-resilient beam member. After engagement, further pivoting of the lock arm causes the middle portion of the lock arm to flexibly arch outwardly away from the plug connector body and out of engagement therewith so as to to enable retraction of the plug connector body from the shroud through the opening.

BRIEF DESCRIPTION OF THE DRAWINGS

This invention will be further described with reference to the accompanying drawings in which.

DETAILED DESCRIPTION

Figure 1:
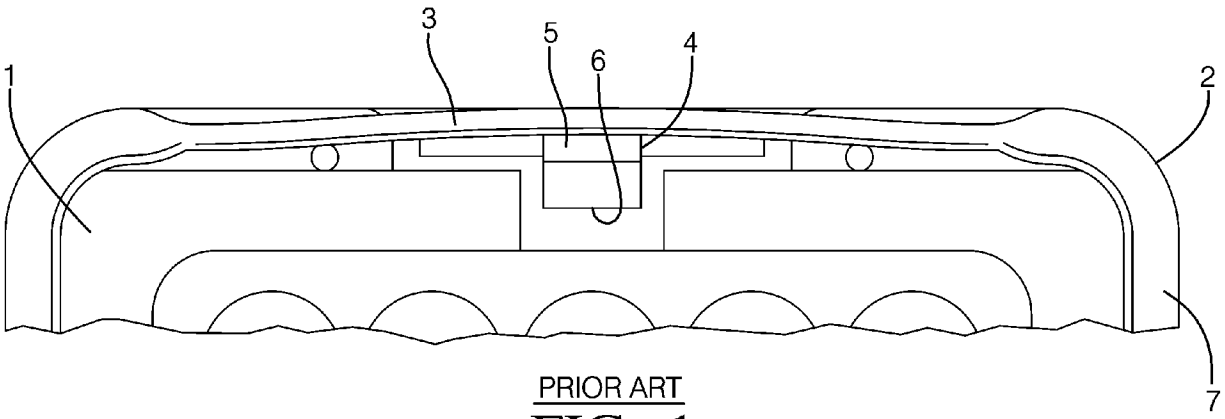
PRIOR ART FIG. 1
FIG. 1 is a front view of a prior art electrical connector body showing a lock arm applying a force to a resilient hold-down beam and the hold down beam flexing due to the applied force of the lock arm.
Figure 2:
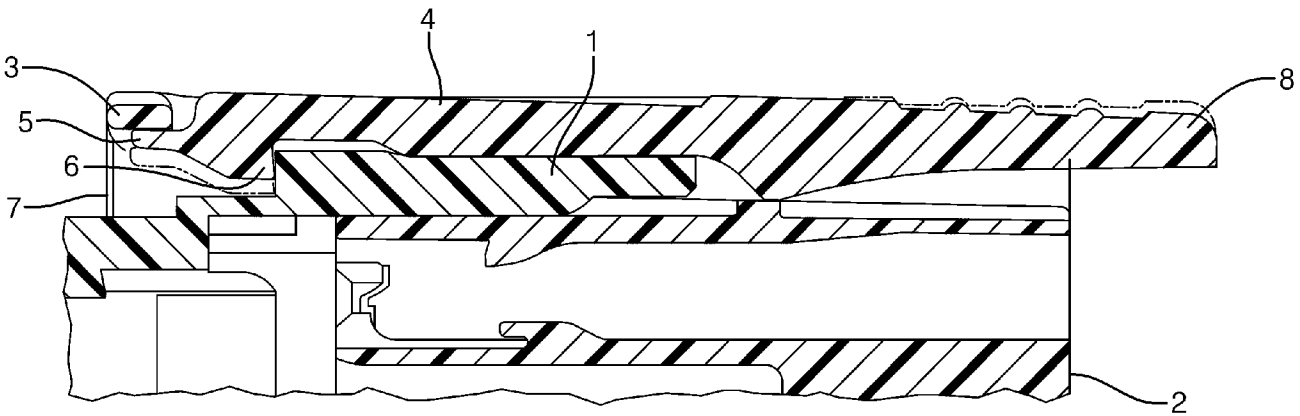
PRIOR ART FIG. 2
FIG. 2 is a longitudinal cross section view of the prior art electrical connector body of FIG. 1.
Figure 3:
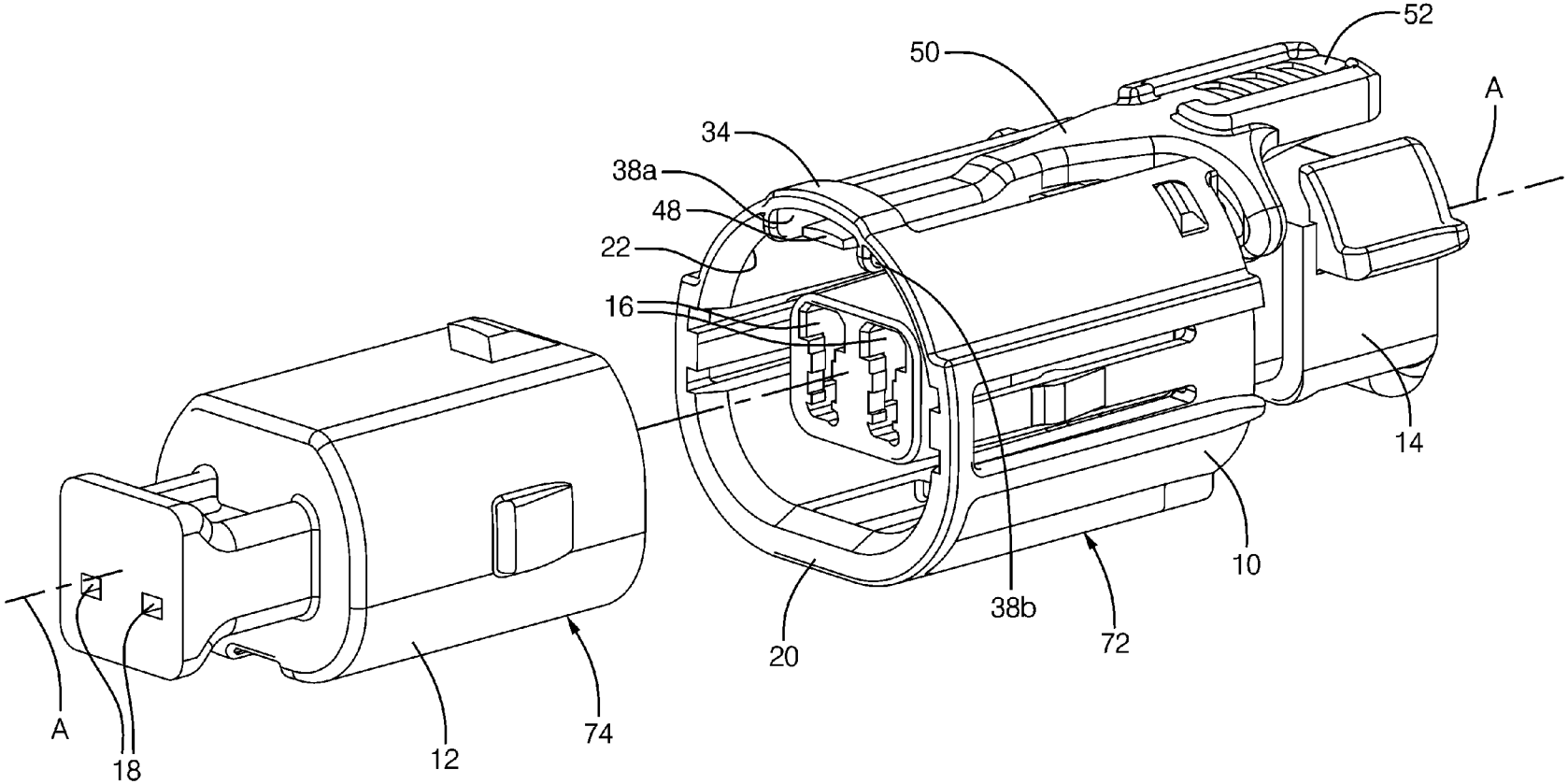
FIG. 3 is a exploded view of a socket body connector according to the invention adapted to receive a corresponding plug connector body.
Figure 4:
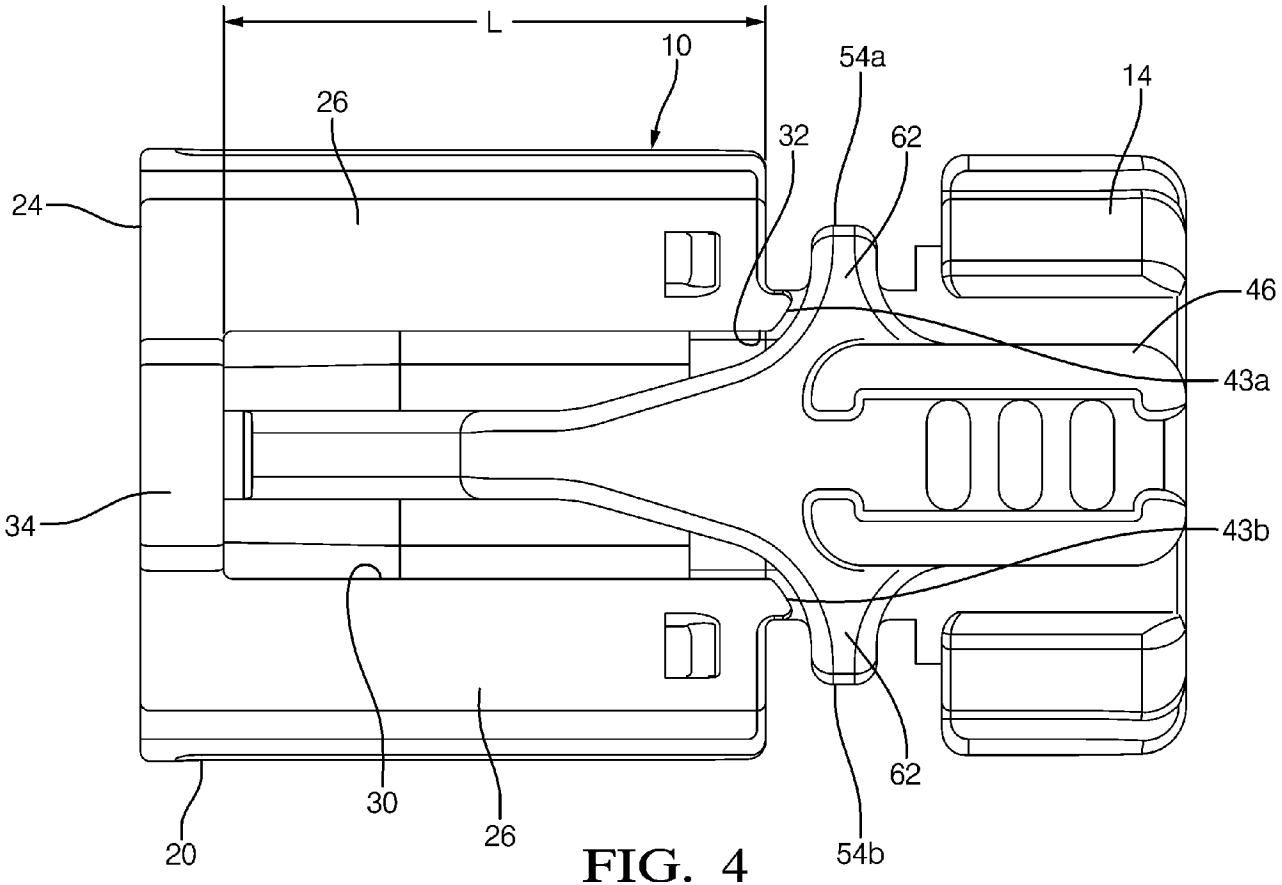
FIG. 4 is a top view of the socket body connector of FIG. 4.
Figure 5:
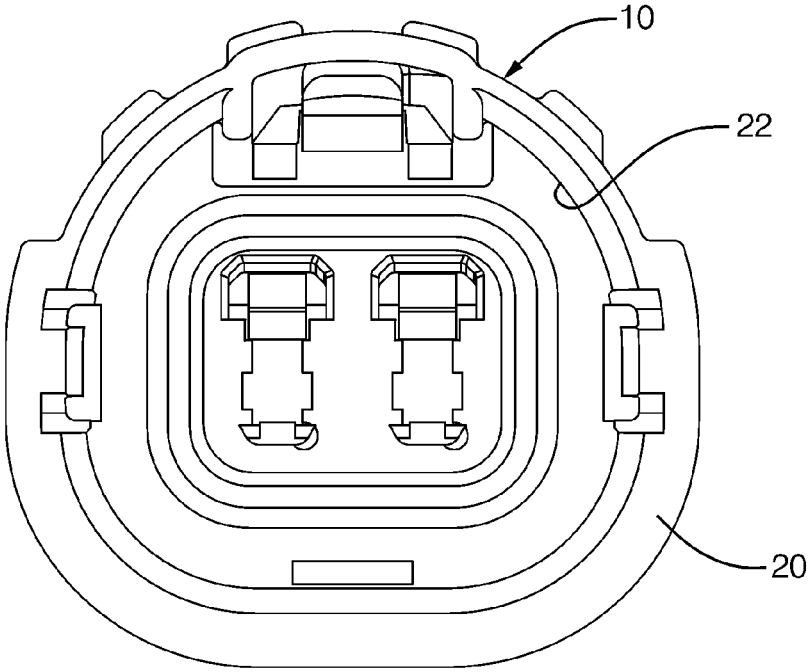
FIG. 5 is a front view of the socket body connector of FIG. 4.
Figure 6:
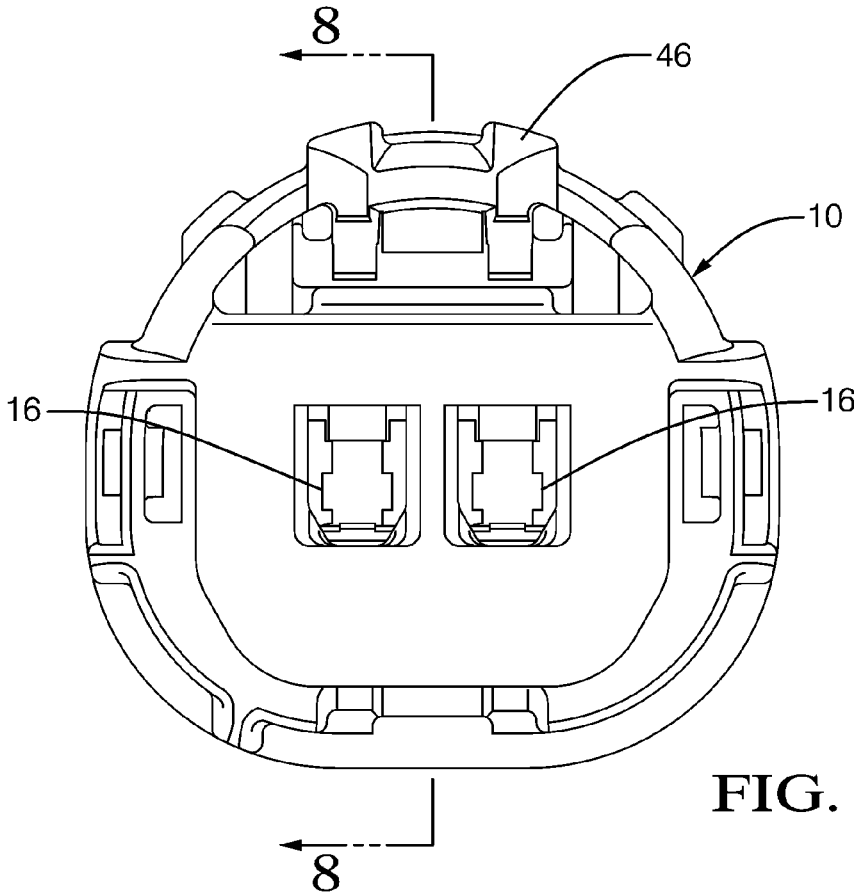
FIG. 6 is a rear view of the socket body connector of FIG. 4.
Figure 7:
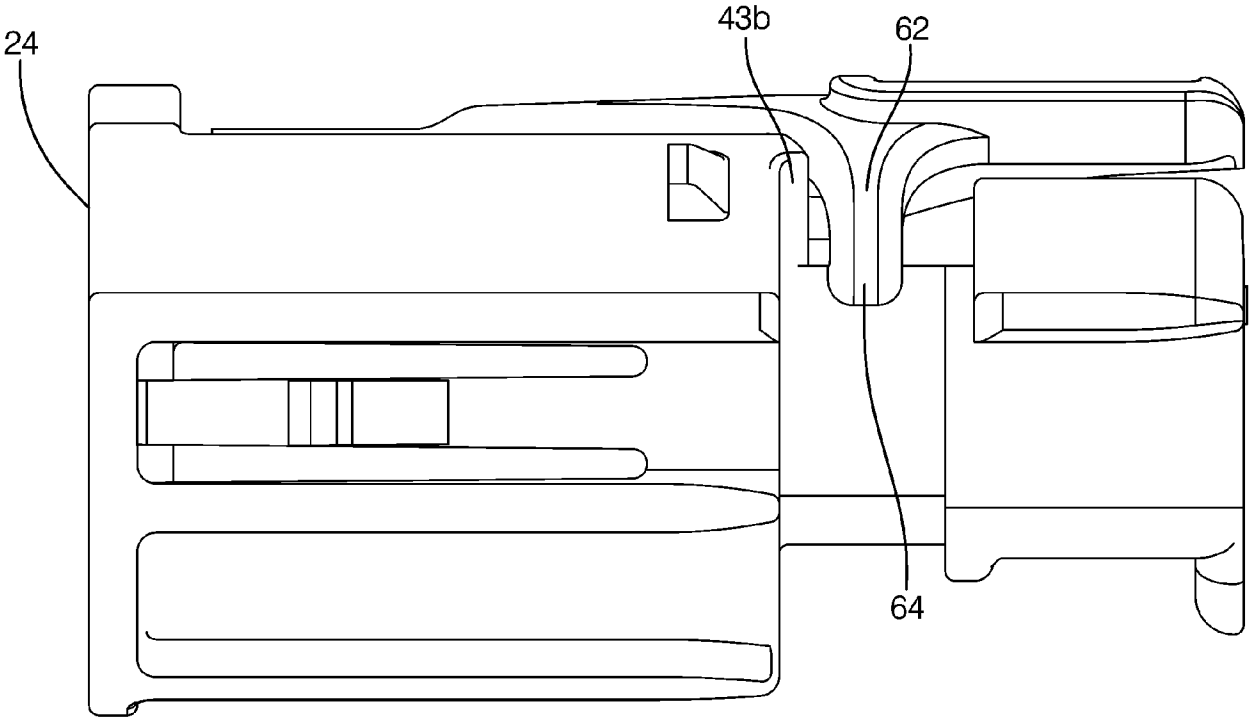
FIG. 7 is a side view of the socket body connector of FIG. 4.
Figure 8:
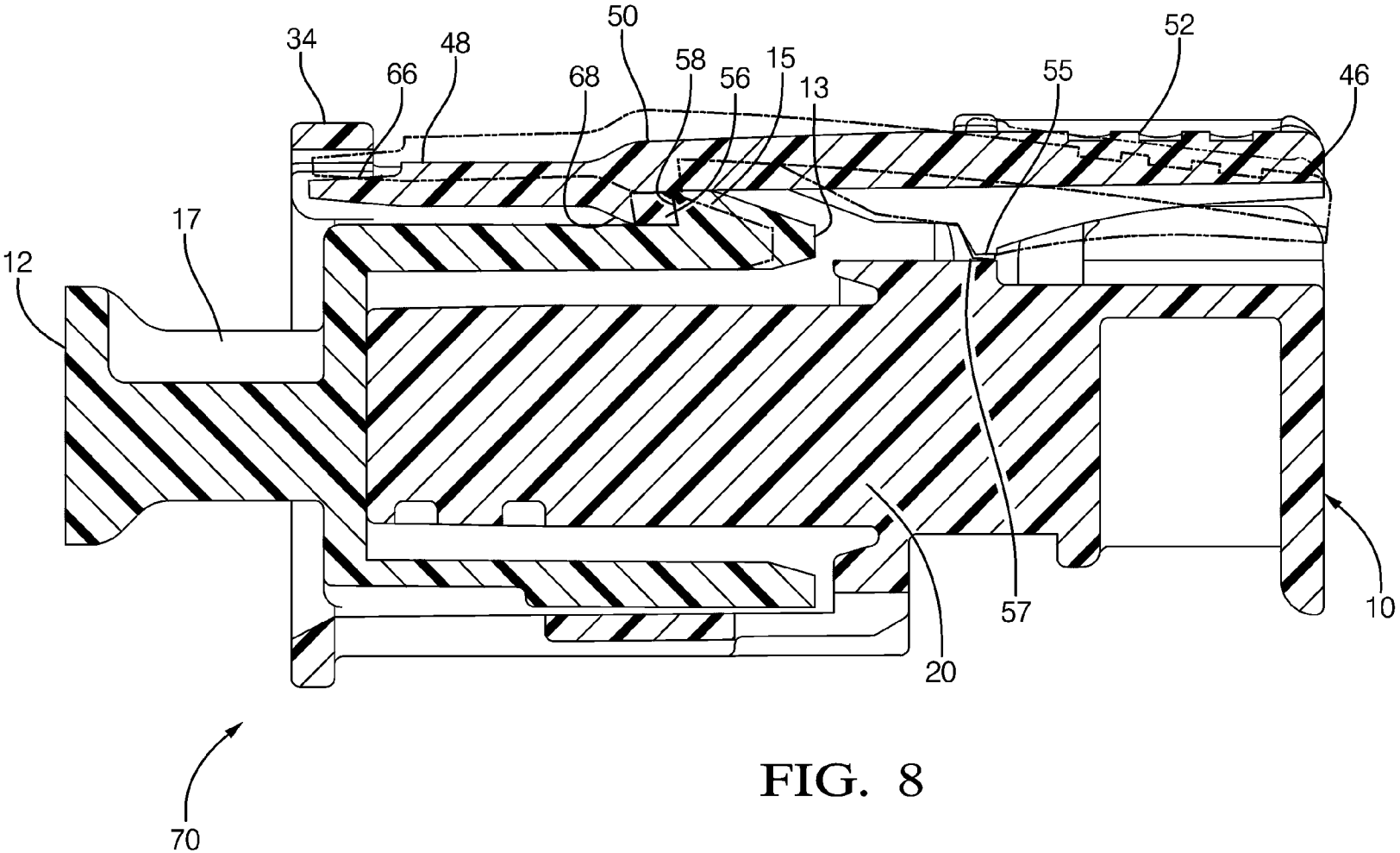
FIG. 8 is a cross section view of the socket body connector of FIG. 7 with the lock arm in a free state of rest taken along the line 8-8 in the direction of the arrows, and a middle portion of the lock arm is flexed as a depressible release lever is being depressed in phantom line.

Referring now to FIG. 3, a socket connector body 10 is disposed along a longitudinal axis A and is adapted to axially receive a plug connector body 12 within socket connector body 10. Each connector body 10, 12 includes terminals that transmit electrical signals through connector bodies 10, 12. Connector bodies 10, 12 may find use in any electrical or electronic application where electrical signals need to be transmitted and routed. For example, connector bodies 10, 12 may find use in the automotive, marine, and other transportation industries.

Connector bodies 10, 12 are electrically non-conductive while the terminals disposed in connector bodies 10, 12 are electrically conductive. Connector bodies 10, 12 may be formed from a non-electrically conducting glass-filled or non-glass filled plastic material as is known in the art. Connector bodies 10, 12 are each injection molded. The socket connector body may include any suitable terminal and the plug connector may include the corresponding terminal that mates with the suitable terminals of the socket body connector when the plug connector body is received in the socket connector body. The terminals disposed in the plug and socket connectors may each be electrically connected to wires having electrical signals. Alternately, the terminals may be directly in connected with a printed circuit board or a flex circuit. The electrical wires are in electrical connection with electrical or electronic circuits generally remote from the plug and socket connector bodies. The electrical terminals are generally formed from any suitable metal that conducts electrical signals. The electrical signals are transmitted by the electrical wires through the socket body connector. Connector bodies 10, 12 include two terminal connections disposed within the connector bodies therein. Alternately, the connector bodies may include one terminal connection. Still yet alternately, the connector bodies may include a plurality of terminal of more than two connections dependent on the application where the plug and socket connector bodies are used. Plug and socket connectors 10, 12 allow the electrical signals to be disrupted when plug connector body 12 is disconnected or retracted from socket connector body 10. For example, disconnecting connecter bodies 10, 12 may be useful to allow a service technician to diagnose and service a faulty circuit in electrical connection with connector bodies 10, 12.

Referring to FIGS. 4-7, socket connector body 10 includes a terminal housing 14 defining terminal cavities 16 extending through housing 14 for receiving the terminals (not shown) therein. Plug connector body 12 further defines cavities 18 receiving corresponding terminals (not shown) that mate with the terminals in socket connector body 10 when plug connector body 12 is received in socket connector body 10. Plug connector body 12 further includes a front edge 13, a forward plug portion 15, and a rearward plug portion 17 remotely opposing forward plug portion 15. At least a portion of rearward plug portion 17 of plug connector body is disposed outside shroud 20 when plug connector body 12 is received in socket connector body 10. Housing 14 includes a shroud 20 that at least partially surrounds housing 14. Shroud 20 may be integrally or separately connected to housing 14 in any suitable manner. Shroud 20 defines a socket 22 having an opening 24 for receiving plug connector body 12. Shroud 20 has an exterior wall 26 and plug connector body 12 is engulfed by exterior wall 26 when plug connector body 12 is received in shroud 20. While exterior wall 26 of shroud 20 is illustrated as being generally rectangular in shape in a transverse cross-sectional profile, exterior wall 26 may be any shape, such as round, square, oval, or elliptical. Exterior wall 26 defines a through slot 30 with an open end 32 remote from opening 24 of shroud 20. A substantially, unyielding, non-resilient beam member 34 spans opening 24 in connection with exterior wall 26 adjacent opening 24 of shroud 20. Non-resilient beam member 34 is suspended integrally connected exterior wall 26 with shroud 20. Guides 38*a*, 38*b* are disposed adjacent each end of non-resilient beam member 34 and spaced generally apart by through slot 30 effective for tooling of the socket body connector and allow keying of plug connector body 12 to align and guide plug connector body 12 under non-resilient beam member 34 and into shroud 20 when plug connector body 12 is received into shroud 20. Accordingly, non-resilient beam member 34 does not flex with an applied force supplied to beam member 34. Alternately, the guides may not be utilized. With smaller sized socket and plug connectors, a length of non-resilient beam member 34 spanning through slot 30 is decreased such that non-resilient beam member 34 is substantially unyieldingly non-resilient. Shroud 20 also includes two overstress ribs 43*a*, 43*b* generally perpendicular to axis A and laterally spaced by open end 32 of through slot 30. Open end 32 of through slot 30 is opposingly remote from non-resilient beam member 34.

Socket connector body 10 includes a lock arm 46. Lock arm 46 is integrally connected with housing 14 aft of shroud 20. Lock arm 46 is also integrally molded with socket connector body 10 when socket connector body 10 is manufactured. Lock arm 46 includes a forward end portion 48, a middle portion 50, a depressible release lever 52, a pair of securement legs 54*a*, 54*b*, and an inwardly extending fulcrum 55. Forward end portion 48 is in connection with middle portion 50. Middle portion 50 is in connection with depressible release lever 52. Middle portion 50 includes a lug, pawl, or lock nib 56. Lock nib 56 is inwardly extending within shroud 20 and is utilized for retaining plug connector body 12 within shroud 20. Nib 20 communicates with a shoulder 58 disposed on plug connector body 12 to ensure locking engagement of socket connector body 10 with plug connector body 12. Open end 32 of through slot 30 is proximate depressible release lever 52. Guides 38*a*, 38*b* assure that a front edge 13 of mating plug connector body 12 will not directly collide with and catch on lock arm 46. Rather, guides 38*a*, 38*b* deflect front edge 13 of mating plug connector body 12 under lock arm 46 to prevent mating plug connector 12 from becoming caught between non-resilient beam member 34 and lock arm 46. Housing 14 further includes a means to pivot the lock arm from its free state of rest that includes a fulcrum reaction pad 57 generally parallel with axis A and substantially aligned and adapted to cooperate with fulcrum 55 to facilitate outward pivoting of forward end portion 48 of lock arm 46 when depressible release lever 52 is depressed.

Lock nib 56 is incorporated into shroud 20 of socket connector body 10 so as to provide a relatively low profile socket connector. Each securement leg 54*a*, 54*b* includes a first end 62 and a second end 64 opposite first end 62. First end 62 of each securement leg 54*a*, 54*b* is integrally connected with depressible release lever 52 adjacent middle portion 50. Second end 64 of each securement leg 54*a*, 54*b* is connected with housing 14 aft of, and spaced apart from shroud 20. Forward end portion 48, middle portion 50, and depressible release lever 52 are generally disposed parallel with axis A. Forward end portion 48 and middle portion 50 are axially disposed along through slot 30 within a length L of through slot 30. Length L does not include the portion of shroud 20 that includes non-resilient beam member 34. Securement legs 54*a*, 54*b* and depressible release lever 52 are not disposed along through slot 30. Securement legs 54*a*, 54*b* are generally disposed perpendicular to axis A.

Referring to FIGS. 4-8, non-resilient beam member 34 is adapted for communication with forward end portion 48 of lock arm 46 when lock arm 46 is not in a free state of rest. Lock arm 46 is in a free state of rest when plug connector body 12 is not connected with shroud 20 and forward end portion 48 of shroud 20 is disposed such that forward end portion 48 is transversely spaced apart from non-resilient beam member 34 to form a gap. The gap may allow mold tooling to pass therethrough during molding of socket connector body 10. When lock arm 46 is in the free state of rest, lock arm 46 connects with socket connector body 10 only through securement legs 54*a*, 54*b*. Forward end portion 48 includes an engagement pad 66 extending forwardly and disposed inwardly of non-resilient beam member 34.

Socket connector body 10 is not in use when plug connector body 12 is not received within shroud 20 of socket connector body 10. Lock arm 46 is in a state of rest as previously described herein. Electrical signals on the wires of the terminals are not transferred through socket connector body 10.

Socket connector body 10 is in use when plug connector body 12 is received into socket 22. Plug connector body 12 is aligned with guides 38*a*, 38*b* along front edge 13 of plug connector body 12 and plug connector body 12 is axially inserted into opening 24 of shroud 20 from outside socket connector body 10. With insertion of plug connector body 12 in socket 22, front plug portion 15 of plug connector body 12 may slidingly engages along an inner surface of lock arm 46 adjacent shroud 20 along forward end portion 48 and middle portion 50. Plug connector body 12 engages an angled portion 68 of lock nib 56 to elevatingly move lock arm 46 outwardly away from shroud 20 until shoulder 58 of plug connector body 12 moves past lock nib 56. Forward end portion 48 of lock arm 46 may make contact with non-resilient beam member 34 when plug connector body 12 engages lock nib 56. When shoulder 58 of plug connector body has moved past lock nib 56, lock nib 56 elastically moves in a void of plug connector body 12 to be disposed behind shoulder 58 such that lock nib 56 is adjacent shoulder 58. Lock nib 56 cooperating with shoulder 58 retain plug connector body 12 in socket 22 of shroud 20. Terminals (not shown) of plug connector body 12 electrically connect with terminals (not shown) of socket connector body 10 when plug connector body 12 is received in socket 22.

To unplug plug connector body 12 from socket 22, depressible release lever 52 is depressed. Lever 52 is preferably manually depressed in a direction perpendicular to axis A towards socket body connector 10. Depressing lever 52 causes fulcrum 55 to engage fulcrum reaction pad 57. Forward end portion 48 of lock arm 46 then pivots outwardly away from plug connector body 12 toward non-resilient beam member 34 from the free state of rest such that forward end portion 48 makes contact against non-resilient beam member 34. When lever 52 is depressed, lock arm 46 is no longer in a free state of rest. After initial contact with non-resilient beam member 34, lock arm 46 is further adapted to pivot about, and slidingly engage against non-resilient beam member 34 at forward end portion 48 while middle portion 50 of lock arm 46 flexibly arches outwardly away from shroud 20 such that lock nib 56 is lifted outwardly away from plug connector body 12. Because non-resilient beam member 34 is unyielding and non-resilient, beam member 34 becomes another fulcrum allowing middle portion 50 of lock arm 46 to sufficiently flex archingly away in an outward direction from plug connector body 12. Thus, the lock arm behaves in a manner similar to a simple beam structure where the non-resilient beam member cooperates with the depressed depressible release lever to produce a flexed middle portion of the lock arm. Accordingly, lock nib 56 is moved out of engagement with lock shoulder 58 of plug connector body 12. Plug connector body 12 is then ready to be retracted or unplugged from socket connector body 10, being uninhibited by lock nib 56, by axially pulling plug connector body 12 out and away from socket connector body 10. When plug connector body is free from socket 22, the terminals (not shown) of plug connector body 12 are electrically disconnected from the terminals (not shown) of socket connector body 10.

It is undesirable for plug connector body 12 to be forcibly removed from socket connector body 10 without depressing depressible release lever 52. However, should plug connector body 12 be attempted to be forcibly unplugged from socket connector body 10 without depressing depressible release lever 52, overstress ribs 43*a*, 43*b* are configured to limit forward movement of lock arm 46 towards opening 24 of shroud 20. If depressible release lever 52 is not depressed and plug connector body 12 is attempted to be removed from socket 22, lock shoulder 58 engages lock nib 56 and pulls, or moves lock arm 46 towards opening 24 axially away from socket 22. Lock arm 46 axially moves forward toward opening 24 until securement legs 54*a*, 54*b* make contact with corresponding overstress ribs 43*a*, 43*b*. The forward movement of lock arm 46 is halted at a distance commensurate to the spacing between securement legs 54*a*, 54*b* and overstess ribs 43*a*, 43*b* when lock arm 46 is in the free state of rest. Overstress ribs 43*a*, 43*b* assist to prevent undesired damage to connector bodies 10, 12 which may decrease replacement of connector bodies 10, 12 and lower the cost to service connector bodies 10, 12.

In accordance with a further embodiment of the present invention, a plug and socket assembly 70 are provided that include a socket connector body 10 being adapted to receive a plug connector body 12 and plug connecter body 12 including a lock shoulder 58 received in socket connecter body 10. The details of the connector bodies 10, 12 are previously described herein.

In accordance with yet a further embodiment of the present invention, a socket connector 72 is adapted to receive a plug connector 74. The socket connector includes socket connector body 10 disposed along axis A and adapted to axially receive plug connector body 12. Plug connector body 12 includes lock shoulder 58 configured to be received in socket connector body 10. The details of the connector bodies 10, 12 are previously described herein.

While not limited to any particular theory, a width of a securement leg is sufficiently large to allow sufficient torsion force when the lock arm is rotated from the free state of rest, but not so large as to not allow the lock arm to rotate from a free state of rest and prevent the socket connector body from retaining the plug connector body.

While the plug and socket connector bodies may be constructed using a glass-filled or non-glass filled material, the geometry and size of the connector bodies may dictate the material selection. For example, with connector bodies having a geometry including a longer beam member spanning the through slot, constructing the connector bodies with the glass-filled material may be desired. With connector bodies having a geometry including a shorter beam member, constructing the connector bodies using the non-glass filled material may be desired.

With smaller geometry plug and socket connector bodies the nib on the lock arm in communication with the shoulder of the plug may be sufficient to securely lock the plug connector body with the socket connector body. Alternately, additional locks may be utilized on the plug and socket connector bodies to more adequately secure the plug connector body with the socket connector body. Still yet alternately, a socket and plug connector having a plurality of terminals may require the additional connector locks to adequately secure the plug connector body with the socket connector body.

In an alternate embodiment of the invention, the non-resilient beam member may include transverse opposing ends in communication with the shroud or the exterior wall of the shroud that provide a buttress to support the non-resilient beam member.

While the securement legs shown in FIGS. 3-8 are connected with the sides of the lock arm and also connected to a non-shroud portion of the socket connector body, the invention is not limited to this securement leg configuration. Any securement leg configuration may be used that allows the front end of the lock arm to effectively pivot towards the non-resilient beam member may be employed. In an alternate embodiment, the securement leg may take the form of a pedestal integrally connected with the lock arm at one end and integrally connected with the socket connecter body at the other end. In yet another alternate embodiment of the invention, the securement legs may be integrally connected with the lock arm and also integrally connected with the exterior wall of the shroud.

Thus, a socket connector body is provided that receives a corresponding plug connector body that reliably allows a lock nib disposed in the middle portion of the lock arm to be elevated so that a plug connector body may be retracted from the socket connector body. The arching middle portion of the lock arm is effective when employing smaller sized electrical connector bodies where the beam member becomes unyielding and non-resilient due to the smaller size of the connector bodies where displacement of a resilient beam member to allow retraction of the plug connector body is not available. Overstress ribs protect the socket and plug connector bodies from damage if removal of the plug connector body is attempted without depressing the depressible release lever. The socket connector body of the present invention does not require a lock arm having bulky ribbing for strength and for reducing bending along the length of the lock arm as is typically found in conventional electrical connectors. The socket connector body also does not require bulky protective rails extending relatively high above a lock arm allowing for a low profile of the socket connector body and corresponding plug connector body. Also, the socket connector body of the present invention enables the lock arm to be tilted in its molded position to allow mold tooling to pass between a forward end portion of the lock arm and the non-resilient beam member.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A socket connector body, comprising:

a shroud including an opening and adapted to receive a plug connector body through the opening;

a lock arm integrally connected with the socket connector body, said lock arm including a forward end and a middle portion having an inwardly extending lock nib engageable with said plug connector body when it is received in said shroud opening;

a substantially unyielding, non-resilient beam member being integrally connected with the shroud and adapted to overlay the forward end of the lock arm when said lock arm is in a free state of rest; and means to pivot the lock arm from its free state of rest so as to lift the lock arm forward end into engagement with the overlying, non-resilient beam member, wherein, after said engagement, further pivoting of the lock arm causes the middle portion of the lock arm to flexibly arch outwardly and away from the shroud such that the lock nib is lifted outwardly away from the plug connector body and out of engagement therewith to enable retraction of the plug connector body from the shroud through the opening.

2. The socket connector body according to claim 1, wherein the shroud includes an exterior wall, the exterior wall defining a through slot, and the middle portion of the lock arm being disposed along the through slot within a length of the through slot.

3. The socket connector body according to claim 1, wherein the lock arm further includes, at least one securement leg securing the lock arm with the socket connector body, and the lock arm including the at least one securement leg being integrally molded with the socket connector body when the socket connector body is molded.

4. The socket connector body according to claim 3, wherein the at least one securement leg is disposed aft of the shroud and connects with a non-shroud portion of a terminal housing of the socket connector body.

5. The socket connector body according to claim 3, wherein when the lock arm is in said free state of rest the lock arm connects with the socket connector body only through the at least one lock arm securement leg.

6. The socket connector body according to claim 1, further including, at least one overstress rib disposed on an exterior wall of the shroud and being adapted for communication with at least one securement leg, said at least one overstress rib being configured to limit forward movement of the lock arm towards the opening of the shroud when retraction of the plug connector body is attempted without the depressible release lever being depressed, said forward movement of the lock arm being halted when the at least one securement leg makes contact with the at least one overstress rib.

7. The socket connector body according to claim 6, wherein the at least one overstress rib comprises a pair of overstress ribs, and one of the pair of overstress ribs is laterally spaced from the other one of the pair of overstress ribs by the through slot at the open end.

8. The socket connector body according to claim 6, wherein the at least one lock arm securement leg comprises a pair of lock arm securement legs being laterally spaced by a width of the depressible release lever, and one of the pair of lock arm securement legs is adapted for communication with one of the one of the pair of overstress ribs and the other one of the pair of lock arm securement legs is adapted for communication with the other one of the pair of overstress ribs when the plug connector body is retracted from the shroud with the depressible release lever not being depressed.

9. The socket connector body according to claim 1, wherein the shroud includes an exterior wall, the exterior wall defining a through slot, and the lock arm being at least partially disposed along a length of the through slot.

10. The socket connector body according to claim 9, wherein the forward end portion is in connection with the middle portion and the forward end portion and a majority portion of the middle portion are disposed within a length of the through slot, and at least one securement leg of the lock arm and a depressible release lever of the lock arm are not disposed along the through slot.

11. The socket connector body according to claim 9, wherein an open end of the through slot is opposingly remote from the non-resilient beam member, and the open end of the through slot is proximate the depressible release lever.

12. A socket connector adapted to receive a plug connector, comprising:

a socket connector body disposed along a longitudinal axis and adapted to axially receive a plug connector body; and the plug connector body including a lock shoulder configured to be received in the socket connector body, wherein the socket connector body includes, a terminal housing;

a shroud including an opening, said shroud at least partially surrounding the terminal housing and being adapted to receive the plug connector body in the opening to connect with the terminal housing, said shroud including an exterior wall defining a through slot;

a lock arm at least partially axially extending along the through slot and integrally connected with the socket connector body, said lock arm including, a forward end portion;

an inwardly extending lock nib within the shroud for engagement with the plug connector body when the plug connector body is received in to the shroud; and a depressible release lever remote from the forward end portion;

an inwardly extending fulcrum disposed underlying a forward portion of the depressible release lever;

a fulcrum reaction pad underlying the fulcrum; and at least one securement leg securing the lock arm with the socket connector body, a substantially unyielding, non-resilient beam member spanning the through slot and integrally connected with the shroud and in communication with the forward end portion of the lock arm, and the lock arm pivots on the fulcrum in contact with the fulcrum reaction pad to move the forward end portion towards the non-resilient beam member from a free state of rest when the depressible release lever is depressed such that the forward end portion makes contact with the non-resilient beam member, wherein, after the contact with the non-resilient beam member, the lock arm is further adapted to pivot about, and slidingly engage against the non-resilient beam member at the forward end portion while the middle portion of the lock arm flexibly arches outwardly away from the shroud such that the lock nib is lifted outwardly away from the lock shoulder of the plug connector body received in the shroud to enable retraction of the plug connector body from the shroud through the opening.

13. The socket connector according to claim 12, wherein the socket connector body further includes, at least one overstress rib disposed on the shroud adjacent an open end of the through slot and being adapted for communication with the at least one securement leg.

14. The socket connector according to claim 13, wherein the at least one overstress rib is configured to limit forward movement of the lock arm towards the opening of the shroud when retraction of the plug connector body is attempted without the depressible release lever being depressed, said forward movement of the lock arm being halted when the at least one securement leg makes contact with the at least one overstress rib.

15. A plug and socket connecter assembly, comprising:

a socket connector body adapted to receive a plug connector body; and the plug connecter body including a lock shoulder received in the socket connecter body, wherein the socket connecter body includes, a terminal housing;

a shroud including an opening, said shroud at least partially surrounding the terminal housing and being adapted to receive the plug connector body in the opening to connect with the terminal housing, said shroud including an exterior wall defining a through slot;

a lock arm at least partially axially extending along the through slot and integrally connected with the socket connector body, said lock arm including, a forward end portion;

an inwardly extending lock nib within the shroud for engagement with the plug connector body when the plug connector body is received in to the shroud; and a depressible release lever remote from the forward end portion;

an inwardly extending fulcrum disposed underlying a forward portion of the depressible release lever;

a fulcrum reaction pad underlying the fulcrum; and at least one securement leg securing the lock arm with the socket connector body, a substantially unyielding, non-resilient beam member spanning the through slot and integrally connected with the shroud and in communication with the forward end portion of the lock arm, and the lock arm pivots on the fulcrum in contact with the fulcrum reaction pad to move the forward end portion towards the non-resilient beam member from a free state of rest when the depressible release lever is depressed such that the forward end portion makes contact with the non-resilient beam member, wherein, after the contact with the non-resilient beam member, the lock arm is further adapted to pivot about, and slidingly engage against the non-resilient beam member at the forward end portion while the middle portion of the lock arm flexibly arches outwardly away from the shroud such that the lock nib is lifted outwardly away from the lock shoulder of the plug connector body received in the shroud to enable retraction of the plug connector body from the shroud through the opening.

16. The plug and socket connecter assembly according to claim 15, wherein the socket connector body further includes, at least one overstress rib disposed on the shroud adjacent an open end of the through slot and in communication with the at least one securement leg.

17. The socket connector according to claim 16, wherein the at least one overstress rib is configured to limit forward movement of the lock arm towards the opening of the shroud when retraction of the plug connector body is attempted without the depressible release lever being depressed, said forward movement of the lock arm being halted when the at least one securement leg makes contact with the at least one overstress rib.

* * * * *